US006338352B1

(12) United States Patent
Raches et al.

(10) Patent No.: US 6,338,352 B1
(45) Date of Patent: Jan. 15, 2002

(54) SELF-RISING DOOR HANDLE

(75) Inventors: Scott D. Raches; Robert A. Elick, both of Jackson, TN (US); Cory D Howe, North Little Rock, AR (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/372,942

(22) Filed: Aug. 12, 1999

(51) Int. Cl.[7] ..... B08B 3/02
(52) U.S. Cl. ..... 134/200; 134/201; 16/904
(58) Field of Search ..... 16/904; 134/56 D, 134/57 D, 58 D, 201, 20

(56) References Cited

U.S. PATENT DOCUMENTS 3,314,746 A * 4/1967 Millar
4,046,508 A * 9/1977 McDonald
4,086,929 A * 5/1978 Focht
5,314,668 A * 5/1994 Biermaier
5,630,438 A * 5/1997 Hoover et al.
5,863,497 A * 1/1999 Dirksing

FOREIGN PATENT DOCUMENTS

DE 2364647 * 6/1975
JP 7-322990 * 12/1995

* cited by examiner

*Primary Examiner*—Frankie L. Stinson
(74) *Attorney, Agent, or Firm*—Barley, McKee, Thomte, Voorhees & Sease

(57) ABSTRACT

A handle is provided on the interior side of a dishwasher door so as to facilitate the raising of the door from a low opened position. The handle is pivotally mounted within the door so as to move between an upstanding position when the door is open to a flush position when the door is closed. A counter weight is provided in the handle so the handle automatically rises to the upstanding position when the dishwasher door is moved from the closed position to the open position.

10 Claims, 2 Drawing Sheets

SELF-RISING DOOR HANDLE

BACKGROUND OF THE INVENTION

A dishwasher normally has a door which moves between a vertical closed position and a horizontal open position. When the door is open, it is positioned relatively low and close to the floor. To move the door from the open position to the closed position requires a person to bend over to reach the door with their hand. Alternatively, it is known that people often raise the door from the lower open position by using their foot to gently kick the door upwardly, so as to avoid having to bend over. Bending over to close the opened door is difficult for some people, while kicking the door closed may cause damage to the dishwasher. Therefore, it is desirable to eliminate or minimize bending by the person closing the door, and to eliminate kicking the door closed.

Accordingly, a primary objective of the present invention is the provision of an easily assessable handle on the inside of the dishwasher door to facilitate raising the door from the low open position.

Another objective of the present invention is the provision of a dishwasher door handle which is self-rising when the door is in the open position.

A further objective of the present invention is the provision of a handle which is pivotally mounted on the inside of the dishwasher door and which automatically moves from a flush position to maintain full dish loading capacity when the door is closed to an upstanding position when the door is open.

Another objective of the present invention is the provision of a handle on the interior of a dishwasher door which does not interfere with the lower dishwasher rack being fully rolled out onto the opened door for loading.

These and other objectives will become apparent from the following description of the invention.

SUMMARY OF THE INVENTION

This invention is directed towards a handle provided on the interior surface of a dishwasher door to facilitate lifting of the door from the horizontal open position to the vertical closed position. The handle is pivotally mounted upon the door and includes a counter weight so as to automatically maintain the handle in a vertical orientation, regardless of the position of the door. The handle is substantially flush with the interior panel of the door when the door is closed and automatically pivots to an upstanding position relative to the interior door panel when the door is moved to the open position. Thus, the handle can be easily grasped by a person with little, if any, bending, so as to raise the door from the low opened position. The pivotal mounting of the handle in the door allows the handle to be pivoted downwardly by the lower dishwasher rack when the rack is rolled onto the door for loading.

DETAILED DESCRIPTION OF THE DRAWINGS

Figure 1:
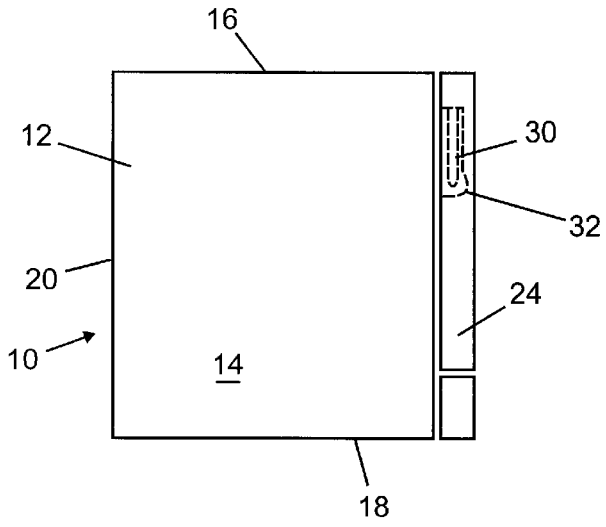
FIG. 1 is a side elevation view showing the position of the door handle of the present invention when the dishwasher door is in the closed position.

A conventional dishwasher 10 includes a cabinet 12 with opposite side walls 14, a top wall 16, a bottom wall 18, and a rear wall 20 which define a washing chamber. Typically, an upper rack (not shown) and a lower rack 22 are rollably mounted within the cabinet 12 for holding dishes, glasses, utensils, and other objects to be washed.

Figure 3:
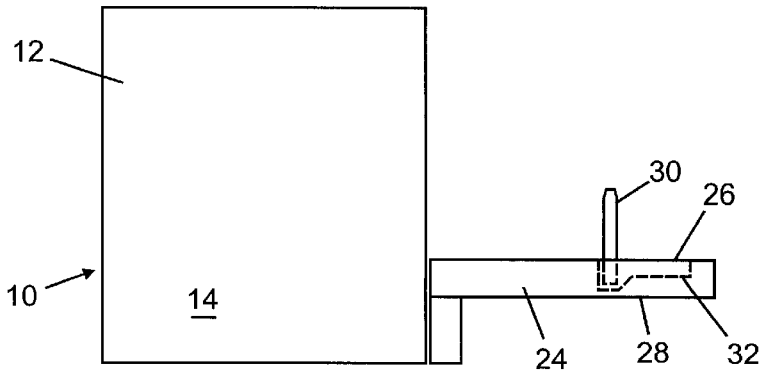
FIG. 3 is a side elevation view showing the upstanding position of the door handle when the door is fully opened.
Figure 4:
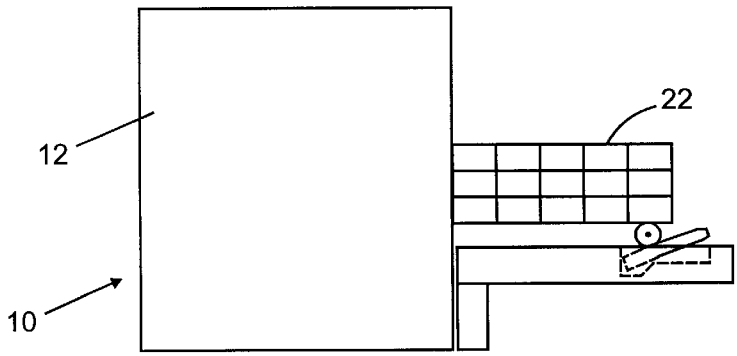
FIG. 4 is a side elevation view showing the position of the handle when the lower dishwasher rack is rolled out of the washing chamber onto the door for loading.
Figure 5:
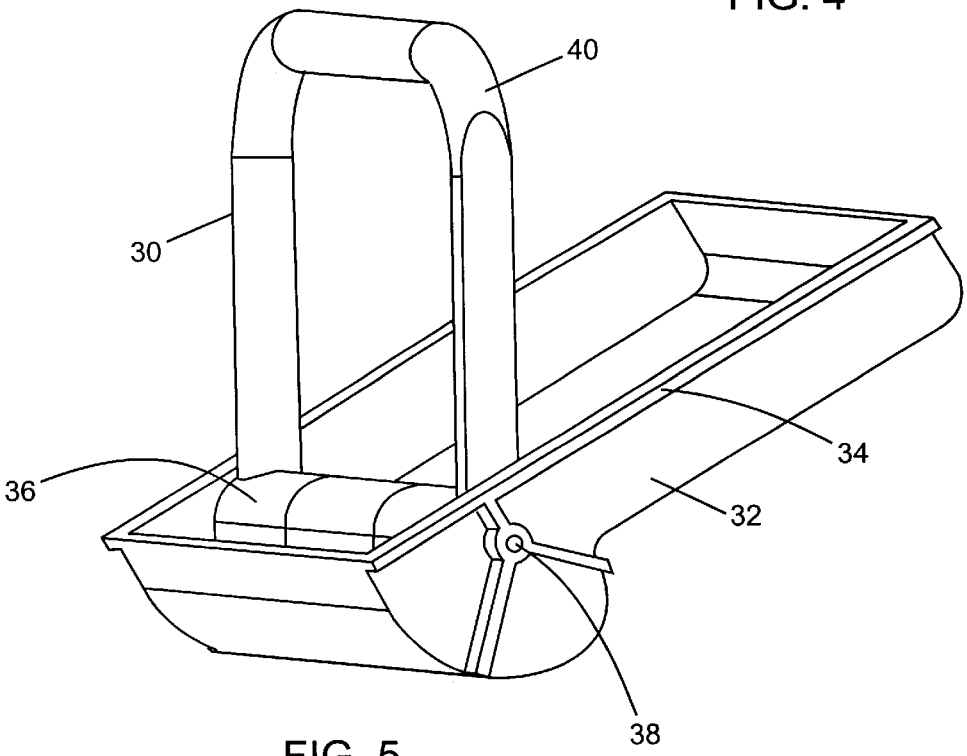
FIG. 5 is a perspective view of the door handle and housing according to the present invention with the handle oriented in an upstanding position.

A door 24 is pivotally mounted to the cabinet 12 for movement between a closed position covering the front opening of the washing chamber, as shown in FIG. 1, and an open position providing access to the washing chamber, as shown in FIG. 3. In the open position, the door 24 is horizontally oriented and positioned relatively low and close to the floor. The door 24 has opposite interior and exterior sides or panels 26, 28 respectively.

The present invention is directed towards a handle 30 which is pivotally mounted in the door 24 to facilitate raising of the door 24 from the low opened position. More particularly, a housing 32 is mounted in the interior panel 26 of the door 24. The housing 32 includes an outer perimeter flange 34. An appropriate seal is provided between the flange 34 of the housing 32 and the interior panel 26 so as to prevent water leakage between the interior and exterior sides of the door 24. As an alternative to the housing 32, a recess or cavity can be molded or formed into the interior panel 26 of the door 24 to accommodate the handle 30 as further described below.

Figure 2:
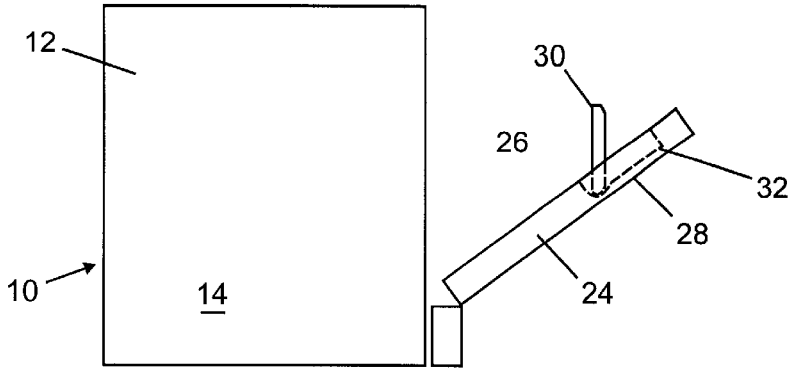
FIG. 2 is a side elevation view showing the position of the door handle relative to the door when the door is partially opened.
Figure 6:
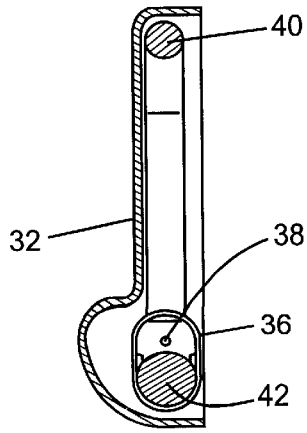
FIG. 6 is a sectional view of the handle and housing as oriented when the dishwasher door is closed.

The handle 30 includes a base 36 which is pivotally mounted to the opposite sides of the housing 32 so as to be pivotal about a pivot axis 38. A U-shaped handle grip 40 extends from the base 36. It is understood that the grip 40 may take other configurations, such as a T-shape. A counter weight 42 is provided within the base 36 below the pivot axis 38, as best seen in FIG. 6. The counter weight 42 maintains the grip 40 in a vertical orientation, regardless of the position of the door, as seen in FIGS. 1–3.

When the door 24 is closed, as seen in FIG. 1, the handle grip 40 is contained within the housing 32 so as to be substantially flush with the interior panel 26 of the door 24. As the door 24 is moved from the closed position to the open position, the counter weight 42 causes the grip 40 to pivot out of the housing 32 so as to be in an upstanding position when the door 24 is fully opened, as shown in FIG. 3. When the lower rack 22 is rolled from the washing chamber outwardly onto the door 24 for loading, the lower front edge of the rack 22 engages the handle 30 which pivots downwardly, thereby allowing the rack 22 to be fully withdrawn from the washing chamber for loading. Thus, the grip 40 does not interfere with the normal use of the lower rack 22.

Since the grip 40 extends upwardly above the interior panel 26 of the door 24 when the door 24 is in the open position, a person can easily grasp the grip 40 of the handle 30 so as to raise the door 24 from the lowered position. The higher elevation of the grip 40 relative to the door 24 eliminates or minimizes the need for a person to bend over to reach the door 24 with his or her hand, and eliminates the undesirable kicking of the door 24 with the person's foot to close the door 24.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved dishwasher having a washing chamber and a door movable between open and closed positions relative to the washing chamber, the door having interior and exterior sides, the improvement comprising:

a handle on the interior of the door to lift the door when in the open position;

wherein the handle includes a pivotal connection to the door such that the handle is pivotal between a substantially flush position along the interior of the door and an upstanding position.

2. An improved dishwasher having a washing chamber and a door movable between open and closed positions relative to the washing chamber, the door having interior and exterior sides, the improvement comprising:

a handle on the interior of the door to lift the door when in the open position;

wherein the handle includes a counterweight to automatically maintain the handle in a vertical orientation when the door is in the open and closed positions.

3. A dishwasher comprising:

a cabinet having opposite side walls, a top wall, a bottom wall and a rear wall forming a washing chamber with an open front;

a door pivotally mounted to the cabinet for movement between a vertically disposed closed position closing the front of the washing chamber and a horizontally disposed open position providing access to the washing chamber;

the door having an inside panel and an outside panel; and a handle on the inside panel of the door for raising the door from the open position;

wherein the handle automatically moves from a flush position to an upstanding position relative to the inside panel of the door when the door is moved from the closed position to the open position.

4. The dishwasher of claim 3 wherein the handle includes a counter weight to automatically move the handle between the flush and upstanding positions.

5. The dishwasher of claim 3 wherein the panel includes a recessed portion for receiving the handle in the flush position.

6. The dishwasher of claim 5 wherein the handle is pivotally mounted in the recessed portion.

7. The dishwasher of claim 3 further comprising a dish rack rollably supported in the washing chamber and adapted to roll forwardly onto the inside panel of the door when the door is open and thereby engage the handle to pivot the handle to the flush position.

8. The dishwasher of claim 3 wherein the handle is pivotally mounted to the inside panel of the door.

9. The dishwasher of claim 3 wherein the handle has a gripping portion spaced above the inside panel when the door is open.

10. An improved dishwasher having a washing chamber and a door movable between a substantially vertical closed position and a substantially horizontal open position relative to the washing chamber, the door having interior and exterior sides, the improvement comprising:

an elongated door handle being movable between a first position flush with the interior side of the door when the door is in the closed position and a second position having an end raised in a vertical direction above the interior side of the door when the door is in the open position.

* * * * *